US005607294A

United States Patent [19]

Gianpiero et al.

[11] Patent Number: 5,607,294

[45] Date of Patent: Mar. 4, 1997

[54] DEVICE FOR AUTOMATICALLY CONTROLLING THE OPERATION OF A BURNER IN GENERAL

[75] Inventors: Turrin Gianpiero, Padua; Sgarbossa Carlo, Mogliano Veneto, both of Italy

[73] Assignee: Sit la Precisa S.r.l., Padua, Italy

[21] Appl. No.: 572,072

[22] Filed: Dec. 14, 1995

[30] Foreign Application Priority Data

Aug. 3, 1995 [IT] Italy ..... PD95A0156

[51] Int. Cl.[6] ..... F23Q 9/08

[52] U.S. Cl. ..... 431/46; 431/54; 431/56

[58] Field of Search ..... 431/45, 46, 53, 431/54, 56

[56] References Cited

U.S. PATENT DOCUMENTS 2,483,191 9/1949 Gauger ..... 431/53

5,020,988 6/1991 Peterson ..... 431/54

*Primary Examiner*—Carroll B. Dority

*Attorney, Agent, or Firm*—Sughrue, Mion, Zinn, Macpeak & Seas

[57] ABSTRACT

A device for automatically controlling the operation of a burner comprises an electric control unit which controls the ignition and the flame of the burner and which opens a normally-closed solenoid valve disposed in a first fuel-supply line to the burner, and a pilot burner for the burner supplied by manually-operable second regulation and safety valve means operatively associated with the control unit and disposed in a second fuel-supply line to the burner, the second valve means being openable manually and being kept open by a current I generated by a thermocouple in the presence of a flame of the pilot burner when the control unit is de-activated and advantageously being closable by the control unit against the action of the current I when the control unit is activated.

8 Claims, 4 Drawing Sheets

DEVICE FOR AUTOMATICALLY CONTROLLING THE OPERATION OF A BURNER IN GENERAL

DESCRIPTION

The present invention relates to a device for automatically controlling the operation of a burner in general.

The use of electric control units for controlling the ignition and the flame in order to control the operation of burners such as, for example, those used in domestic heating systems, is known. These control units supervise the ignition and extinguishing of the burner completely automatically with reference to external electrical signals depending, for example, on time and/or temperature.

It is also known that the aforesaid control units are arranged to stop the flow of fuel to the burner in the event of operating anomalies or power failure in the electrical supply mains.

Manual systems for controlling the ignition and extinguishing of the burner, which enable the burner to operate independently of external electrical energy, are also known.

The control of the operation of the burner by means of these systems, however, is more limited than that permitted by electric control units.

The object of the present invention is to invent a device for automatically controlling the operation of a burner which, on the one hand, enables the burner to operate automatically and, on the other hand, enables the system to be activated manually in the event of temporary external power failure.

This object is achieved by a device for automatically controlling the operation of a burner, comprising:

- an electric control unit for controlling the ignition and the flame of the burner,
- first normally-closed valve means disposed in a first fuel-supply line to the burner and openable by the control unit,
- means, controlled by the control unit for automatically igniting the flame of the burner,
- first flame-detection means associated with the burner and connected to the control unit,
- second manually-operable, normally-closed regulation and safety valve means disposed in a second fuel-supply line to the burner and operatively associated with the control unit,
- a pilot burner for the burner, supplied by the second valve means,
- second flame-detection means associated with the pilot burner and sending a predetermined signal to the second valve means in the presence of a flame of the pilot burner, the second valve means being openable manually and being kept open by the predetermined signal when the control unit is de-activated, and being closable by the control unit against the action of the predetermined signal when the control unit is activated.

Further characteristics and the advantages of the device according to the present invention will become clear from the following description of some embodiments thereof given by way of non-limiting example, with reference to the appended drawings, in which.

Figure 1:
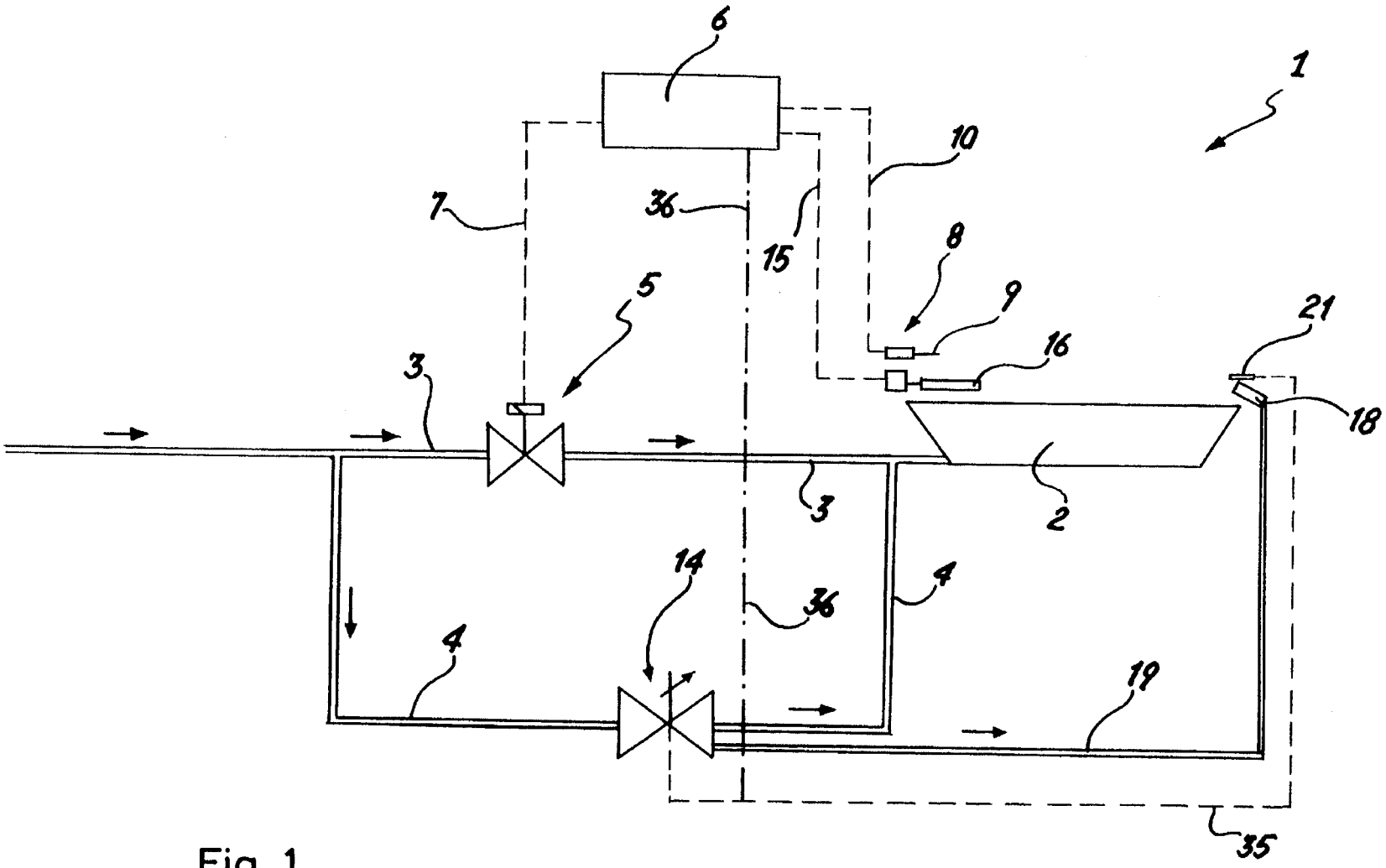
FIG. 1 is a schematic view of a device according to the present invention.
Figure 2:
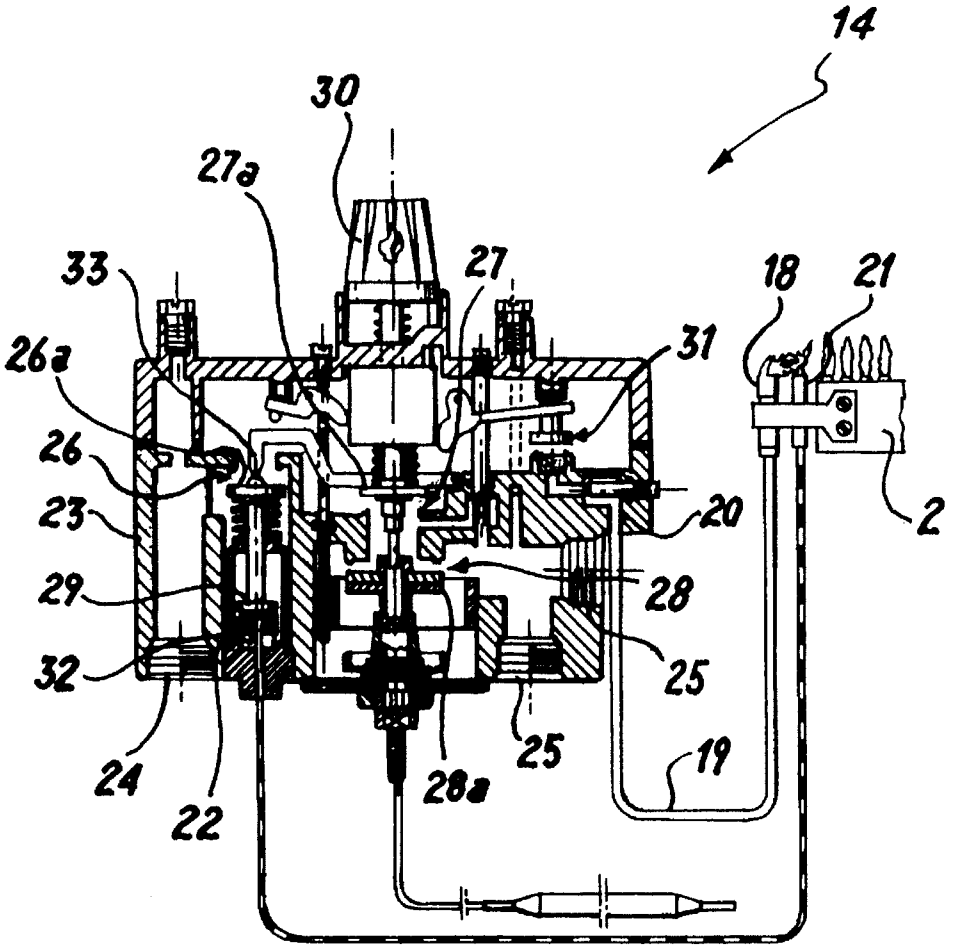
FIG. 2 shows a detail of FIG. 1 in section.

With reference to FIGS. 1 and 2, a device according to the present invention for automatically controlling the operation of a burner 2, for example, of a domestic heating system is generally indicated 1.

The burner 2 is connected to a first fuel-supply line 3. The present description refers, in non-limiting manner, to a gaseous fuel, for example, methane.

A normally-closed solenoid valve 5 disposed in the fuel-supply line 3 to the burner 2 is opened by an electric control unit 6 which controls the ignition and the flame of the burner 2, and to which the solenoid valve 5 is connected by means of electrical leads 7.

The control unit 6 is connected to a mains electrical supply and to a piloting member, for example, such as a thermostat or a timing programmer, not shown in the drawings, on which the desired control parameters (time and/or temperature) are set.

The control unit 6 is connected, by means of electrical leads 10, to means for automatically igniting the flame of the burner 2. According to a preferred embodiment, these automatic ignition means are of the known electrical-resistance type and comprise an ignition element 8 having a filament 9 of conducting material which is intended to be brought to incandescence by the passage of current.

Figure 3:
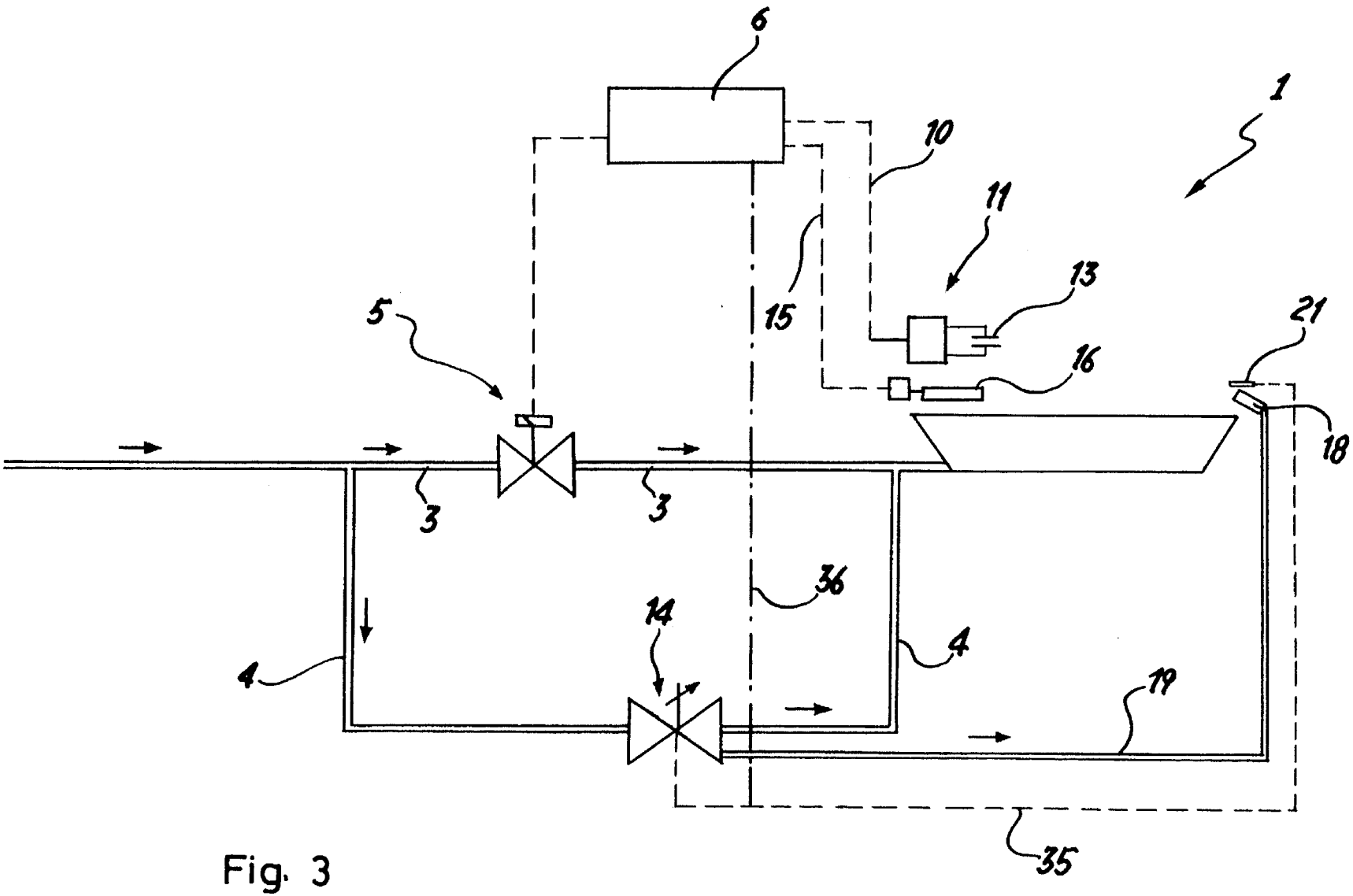
FIGS. 3 and 4 are schematic views of a device according to the present invention, according to two variants thereof.

Alternatively, other ignition means may be used, for example, of the known electrical-discharge type which comprise an ignition element 11 with two electrodes 13 between which the electrical discharge which starts combustion takes place (FIG. 3).

The control unit 6 is connected, by means of electrical leads 15, to flame-detection means 16 associated with the burner 2. According to a preferred embodiment, these flame-detection means are of the known type sensitive to the rectification effect of the flame.

The device 1 also comprises a valve unit 14 of known type for example of the type marketed by the Applicant under the name "BABYSIT", disposed in a second fuel-supply line 4 to the burner 2. The second fuel-supply line to the burner 2 is preferably formed by a pipe by-passing the solenoid valve 5.

A pilot burner 18 of the burner 2 is in fluid communication, through a pipe 19, with a secondary fuel outlet 20 of the unit 14. A flame sensor 21, preferably of the thermocouple type, is associated with the pilot burner 18.

The structure of the valve unit 14 is shown schematically in FIG. 2; it comprises a body 23 defining a fuel path which extends between an inlet opening 24 and one or more outlet openings 25, and along which there are three valves 26, 27 and 28 the obturators of which are indicated **26*a*, 27*a* and 28*a*, respectively. The operation of the unit 14 is completely independent of external electrical supplies, naturally except for the current generated by the thermocouple 21**.

The structural details of the unit 14 are not described below since they are well known to experts in the art; in this connection it suffices to know that the construction is such that, to enable the pilot burner 18 to be ignited, a knob 30 is rotated to a predetermined position; in this position, the valve 27 remains closed whilst a fourth valve 31 positioned for shutting off the supply pipe 19 of the pilot burner 18 is brought to the open position. Pressing of the knob 30 then brings the valve 27 into abutment with the corresponding valve seat, shutting off the fuel path in order to prevent the flow of gas to the outlet openings 25.

The obturator **26*a* with a movable armature 29 fixed thereto, is moved by a lever 33 towards a position in which the corresponding valve is opened, consequently bringing the movable armature 29 into contact with an electromagnet 32 which is connected to the thermocouple 21 by means of leads 35** and can be excited by the current generated owing to the heating of the latter.

A fuel passageway is thus established and enables the pilot burner 18, but not the main burner 2, to be ignited, since the supply to the latter is cut off by the obturator 27*a* of the valve 27. The presence of a flame in the pilot burner 18 is detected by the thermocouple 21 which, when it is heated, produces sufficient current to excite the electromagnet 32 so as to hold the valve 26 in the open position.

If the knob 30 is then released and rotated the valve 27 is brought to the open position and the position of the obturator 28*a* relative to the corresponding seat, and consequently the flow of gas to the main burner 2, can be regulated by the knob. Alternatively, the obturator 28*a* is associated with a mechanical thermostat.

Electrical leads 36 connect the electric control unit 6 to the electrical leads 35.

Starting from an initial condition in which the control unit 6 is supplied electrically by the normal electric mains, that is, with the burner 2 subservient to its control in conventional manner, it is supposed that the external energy supply is interrupted so that the flame of the burner 2 goes out as a result of the closure of the valve 5.

In this situation the burner 2 can be supplied by means of the second, fuel-supply line which by-passes the solenoid valve 5.

If the knob 30 is pressed and the operations indicated above are performed, the valve unit 14 is activated and the operative control of the main burner 2 and of the pilot burner 18 are made subservient thereto.

When electrical energy returns to the supply mains, the electric control unit 6 is re-activated and sends an alternating electric interference current to the winding of the electromagnet 32 by means of the electrical leads 36 and 35. As a result, there is no longer an attraction force between the electromagnet 32 and the movable armature 29, even in the presence of the current I generated by the sensor 21, so that the obturator 26*a* returns into engagement with the corresponding valve seat, cutting off the flow of fuel through the unit 14.

The ignition and extinguishing of the burner 2 then return to the control of the electric control unit 6 as before.

Alternatively, the interference current sent to the excitation winding of the electromagnet 32 by the electric control unit 6 in order to interrupt the flow of fuel through the magnetic safety unit 22 may be a direct current flowing in the opposite direction to the current I generated by the flame sensor 21.

Figure 4:
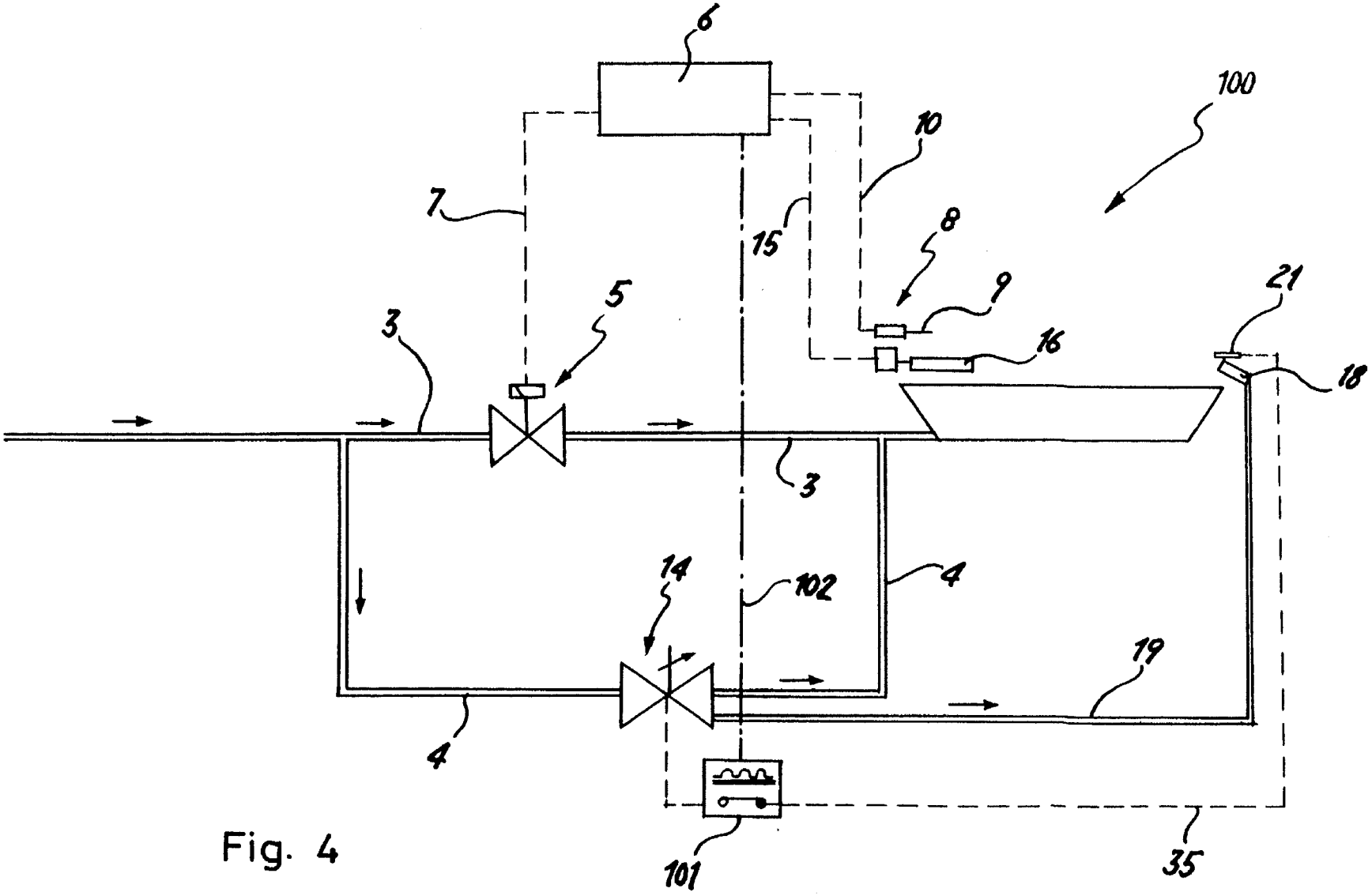

A second embodiment of the device, generally indicated 100, is described below with reference to FIG. 4. Parts structurally and functionally equivalent to corresponding parts of the device 1 are identified by the same reference numerals and are not described below in order not to render the present description unnecessarily lengthy.

In the mechanical device 100, a normally-closed relay 101 is connected in the electrical circuit formed by the leads 35. The relay can be opened by the control unit 6 by means of a lead 102 which connects the control unit 6 to a control gate thereof. In this case in order to interrupt the flow of fuel through the valve unit 14, the electrical control unit 6 opens the relay 101, interrupting the electrical continuity of the electrical leads 35 and thus preventing the current I generated by the flame sensor 21 from flowing in the excitation winding of the electromagnet 32.

As can be appreciated from the foregoing description, one of the advantages of the device according to the present invention lies in the fact that its use enables the burner to be operated manually when the electric control unit of the automatic system for controlling the operation of the burner is de-activated, for example, due to electrical power failure.

A further advantage of the device according to the present invention lies in the fact that its use permits autonomous and automatic return from manual operation in the absence of external electrical energy, to the system for direct control by means of the electric control unit, without the need for intervention by the operator.

Another advantage of the device-according to the present invention lies in the fact that it is reliable and safe in operation.

We claim:

1. A device for automatically controlling the operation of a burner, characterized in that it comprises:

an electric control unit for controlling the ignition and the flame of the burner, first normally-closed valve means disposed in a first fuel-supply line of the burner and openable by the control unit, means, controlled by the control unit for automatically igniting the flame of the burner, first flame-detection means associated with the burner and connected to the control unit, second manually-operable regulation and safety valve means disposed in a second fuel-supply line of the burner and operatively associated with the control unit, a pilot burner for the burner, supplied by means of the second valve means, second flame-detection means associated with the pilot burner and sending a predetermined signal to the second valve means in the presence of a flame of the pilot burner, the second valve means being openable manually and being kept open by the predetermined signal when the control unit is de-activated, and being closable by the control unit against the action of the predetermined signal when the control unit is activated.

2. A device according to claim 1, in which the signal generated is an electric current and the second flame-detection means are connected to the second valve means by first electrical leads.

3. A device according to claim 2, in which a normally-closed relay is connected in the electrical leads and can be opened by the control unit so as to close the second valve means.

4. A device according to claim 2, in which the second valve means and the control unit are connected by second electrical leads so as to send from the control unit to the second valve means an electric current interfering with the electric current generated by the second flame-detection means, bringing about closure of the second valve means.

5. A device according to claim 2, in which the second flame-detection means are a thermocouple and the predetermined signal is a direct current.

6. A device according to claims 4, in which the electric interference current is an alternating current.

7. A device according to claims 4, in which the electrical interference current is a direct current opposing that generated by the thermocouple in the presence of the flame of the pilot burner.

8. A device according to claim 2, in which the second valve means comprise:

a body defining a fuel path extending between an inlet opening and an outlet opening, an electromagnet housed in the body and having an excitation winding in which the current generated by the second flame detection means flows, and a movable armature, a valve seat formed in the fuel path in the body, an obturator for the valve seat, connected to the movable armature of the electromagnet, the obturator being movable manually between a first position in which it is kept resiliently in engagement with the valve seat and the movable armature is spaced from the electromagnet, and an opposite position in which it is disengaged from the valve seat and the movable armature is in abutment with the electromagnet.

* * * * *